US005456220A

United States Patent [19]

Candler

[11] Patent Number: 5,456,220

[45] Date of Patent: Oct. 10, 1995

[54] CROSS-OVER ROD INTERNAL COMBUSTION ENGINE

[76] Inventor: Charles D. Candler, 900 Mahaffey Rd., Powell, Tenn. 37849

[21] Appl. No.: 279,749

[22] Filed: Jul. 22, 1994

[51] Int. Cl.[6] ..... F02B 57/06

[52] U.S. Cl. ..... 123/43 A

[58] Field of Search ..... 123/43 A, 43 AA, 123/197.3

[56] References Cited

U.S. PATENT DOCUMENTS

| | | | |
|---|---|---|---|
| 403,430 | 5/1889 | Hunt . | |
| 1,048,391 | 12/1912 | Brun . | |
| 1,048,468 | 12/1912 | Brun . | |
| 1,050,760 | 1/1913 | Brun . | |
| 1,183,470 | 5/1916 | Lee | 123/43 AA |
| 1,283,575 | 11/1918 | Shepard | 123/43 A |
| 2,081,270 | 5/1937 | Edmundson et al. | 121/62 |
| 2,444,764 | 7/1948 | Baker | 123/43 A |
| 3,923,018 | 12/1975 | Markowitz | 123/43 A |
| 3,973,531 | 8/1976 | Turner | 123/43 A |
| 4,060,060 | 11/1977 | Turner | 123/43 A |
| 4,307,695 | 12/1981 | Vasilantone | 123/559.1 |
| 4,741,300 | 5/1988 | Benson | 123/43 R |
| 4,836,149 | 6/1989 | Newbold | 123/44 R |
| 4,867,107 | 9/1989 | Sullivan et al. | 123/43 A |
| 4,966,000 | 10/1990 | Wolters | 60/595 |
| 4,974,553 | 12/1990 | Murray et al. | 123/44 B |
| 5,090,372 | 2/1992 | Murray et al. | 123/44 B |
| 5,094,195 | 3/1992 | Gonzalez | 123/58 BA |
| 5,103,775 | 4/1992 | Hue | 123/43 R |
| 5,222,427 | 6/1993 | Molitorisz | 91/500 |

FOREIGN PATENT DOCUMENTS

| | | | |
|---|---|---|---|
| 2914 | 1/1915 | United Kingdom | 123/43 A |

*Primary Examiner*—Michael Koczo
*Attorney, Agent, or Firm*—Pitts & Brittian

[57] ABSTRACT

A cross-over rod internal combustion engine (10). The engine (10) includes a power train including a receiving cylinder (12) and a power output cylinder (34) disposed at a right angle to each other and coupled by a plurality of rods (40), each defining a 90° bend. The receiving cylinder (12) and the power output cylinder (34) react to an axial force applied to a piston (48) received within one of the cylinder bores (14). The housing (52) carries a lead wire (88) for firing a spark plug (84) associated with each cylinder bore (14) as the cylinder bore (14) rotates past the lead wire (88). An oil duct (92) is provided for circulating oil from the lower housing (68) to the upper portion of the upper housing (52). A fuel and air mixture is introduced into the individual cylinder bores (14) through an inlet port (16) and is evacuated, when spent, through an exhaust port (18). In similar fashion, water is introduced through a water inlet (20) and is evacuated through a water outlet (22) during the rotation of the receiving cylinder (12). A spring (114) is positioned proximate the bottom of each of the cylinder bores (14). The spring (114) serves to absorb the inertia of the piston (48) as it approaches the bottom of its stroke, the energy absorbed by the spring (114) being used to push the piston (48) back toward the top of its stroke.

17 Claims, 5 Drawing Sheets

CROSS-OVER ROD INTERNAL COMBUSTION ENGINE

This application in part discloses and claims subject matter disclosed in my earlier filed application, Ser. No. 08/100,453 filed on Jul. 30, 1993, now abandoned. 1. Technical Field This invention relates to the field of internal combustion engines. More specifically, this invention relates to an internal combustion engine having a rotating block with a power train oriented at a right angle thereto.

2. Background Art

In the field of motor engines, it is well known that many different engines exist which are operated using internal combustion principles. Included are combustion engines which operate with either a two-stroke cycle or a four-stroke cycle. Conventional engines are associated with an oil pump for circulating oil for lubricating and cooling the internal moving parts. Conventional oil pumps require a substantial amount of power to operate. Further, conventional oil pumps inherently elevate the operating temperature of the oil due to the high pressures required to lubricate the engine. Conventional oil pumps have been known to fail, thus causing substantial, if not complete, destruction of the engine.

Conventional engines require distributors to fire the individual spark plugs in a predetermined sequence. It is well known that distributors can be expensive to manufacture, require power to operate, and are known to fail. Further associated with conventional engines are cooling fans and water pumps for cooling the engine while in operation. Conventional water pumps are driven by belts and pulleys and are often undependable.

In the operation of a conventional engine, it is well known that the rods connected between the pistons and the crank shaft are disposed at an angle greater than zero in relation to the centerline of the wrist pin and the main journals of the crank shaft, except at the top and bottom of the stroke of the particular piston. Due to this angle, hereinafter referred to as the rod angle, forces for rotating the crank shaft are reduced. It is well known that the rod angle can be reduced by increasing the rod length. However, increasing the rod length results in increasing the overall size of the engine.

In a conventional two-cycle engine, the piston closes the exhaust port to prevent unspent fuel from escaping and to allow for the compression of the fresh charge above the exhaust port. However, concessions must be made in order to sufficiently evacuate spent fuel and air. Specifically, by locating an exhaust port in the upper portion of the cylinder, a reduced amount of compression within the cylinder is achievable and a greater amount of unspent fuel is evacuated. On the other hand, to position the exhaust port lower in the cylinder, less spent fuel is exhausted.

In order to overcome several of the problems associated with conventional internal combustion engines, several internal combustion engines having a rotating block or which drive a rotating output block have been developed. Typical of the art are those devices disclosed in the following U.S. Patents:

| Pat. No. | Inventor(s) | Issue Date |
|---|---|---|
| 403,430 | C. R. Hunt | May 14, 1889 |
| 1,048,391 | L. Brun | Dec 24, 1912 |
| 1,048,468 | L. Brun | Dec 24, 1912 |

-continued

| Pat. No. | Inventor(s) | Issue Date |
|---|---|---|
| 1,050,760 | L. Brun | Jan 14, 1913 |
| 2,081,270 | J. G. Edmundson, et al. | May 25, 1937 |
| 3,973,531 | W. F. Turner | Aug 10, 1976 |
| 4,060,060 | W. F. Turner | Nov 29, 1977 |
| 4,307,695 | M. Vasilantone | Dec 29, 1981 |
| 4,741,300 | D. W. Benson | May 3, 1988 |
| 4,836,149 | V. D. Newbold | Jun 6, 1989 |
| 4,867,107 | R. W. Sullivan, et al. | Sep 19, 1989 |
| 4,966,000 | C. A. Wolters | Oct 30, 1990 |
| 4,974,553 | J. L. Murray, et al. | Dec 4, 1990 |
| 5,090,372 | J. L. Murray, et al. | Feb 25, 1992 |
| 5,094,195 | C. Gonzalez | Mar 10, 1992 |
| 5,103,775 | A. Hue | Apr 14, 1992 |
| 5,222,427 | J. Molitorisz | Jun 29, 1993 |

Of particular interest of the prior art devices are those disclosed by Sullivan, et al. ('107); Turner ('531 and '060); Brun ('391, '468, and '760); Edmundson ('270); and Molitorisz ('427). The engines disclosed by Sullivan, et al. ('107) and Turner ('531 and '060) are rotary vee engines. The remaining of these patents disclose motors having pistons defining right angles.

Sullivan, et al. ('107), disclose a rotary vee engine including twelve "V"-shaped cylinders. Six rods are provided, with each having a piston disposed at either end. The pistons spin in the respective cylinder bores which creates high friction and a decrease in power. Due to the configuration of the '107 engine, the cylinder bores are limited to a small diameter, which reduces the engine displacement and creates a high bore to stroke ratio. As a result, the power output is minimal while the external dimensions are relatively large, as compared to conventional engines with similar displacement.

The angle defined by each of the rods of the '107 engine is approximately 30°, and in any event less than 90°. Because the angle is less than 90°, when the engine fires, there is a low resultant force provided for rotating the block, while the majority of the energy is spent trying to compress the rod and separate the opposite ends of the housing. Sullivan, et al., confirm the problems with conventional rotary vee engines at column 1, line 59 through column 2, line 12 as a result of the orientation of the two rotating cylinder blocks.

A further problem resulting from the engine configuration disclosed by Sullivan, et al., is that discussed previously with respect to conventional two-cycle engines. Specifically, the rods of the '107 engine define a series of grooves formed in each end thereof, the grooves being provided for opening and closing the intake and exhaust ports as the rods rotate. This configuration causes a reduction in compression when the rod has reached its fullest extent within the cylinder.

Those engines disclosed by Turner ('531 and '060) suffer from problems similar to the Sullivan ('107) engine and other conventional rotary vee engines as discussed.

The '391 and '468 motor disclosed by Brun, the '270 rotary engine disclosed by Edmundson, et al., and the '427 motor disclosed by Molitorisz are each hydraulically-powered motors having piston rods bent at 90° angles. The piston rods engage a rotating block at each end. As a fluid is forced into a cylinder, the respective end of the piston rod is pushed away, thus causing rotation of each of the rotating blocks. With these types of devices, it is taught that a hydraulic pump is necessary to force the hydraulic fluid into the individual cylinders. Therefore, these motors are not self-sufficient.

The '760 motor disclosed by Brun is described as a steam engine. Hollow pistons are provided within which steam is received and compressed. Although the Brun '760 patent discloses that the subject engine may be constructed as an explosive or internal combustion engine, there is no disclosure indicating how this adaptation is possible for the disclosed device. Nor is such a disclosure made as to how any other of the hydraulic motors discussed above can be so adapted, given that internal combustion engines are fundamentally distinguishable over hydraulic and steam engines.

In motors of the type wherein a power train is provided which includes two rotating cylinders coupled by rods configured having right-angle bends, it is preferred to incorporate a minimal number of rods to allow for a smaller diameter cylinder. By minimizing the diameter of the cylinder, the force required to rotate the cylinder is also minimized. By incorporating rods bent at a 90° angle, the axial force applied to a particular rod is directly transferred as rotational force on the rotating block disposed at a right angle thereto.

In an internal combustion engine, it is necessary to provide intake and exhaust ports for the introduction of fuel and air and the evacuation of the same upon combustion thereof. In the particular internal combustion engine wherein two rotating cylinders disposed at a right angle are provided, it is desirable to incorporate intake and exhaust ports which are opened and closed as a function of the orientation of the rotating cylinder with respect to the housing, and not as a function of the axial position of the piston with respect to the cylinder bore within which the piston is reciprocating, as is the case for conventional two-cycle engines.

Therefore, it is an object of this invention to provide an internal combustion engine wherein a power train is comprised of two rotating cylinders disposed at a right angle and coupled with a plurality of rods, each defining a 90° bend.

Another object of the present invention is to provide such an internal combustion engine wherein the number of pistons incorporated is optimized such as to provide a maximum volume of displacement while defining minimal external dimensions of the engine.

Still another object of the present invention is to provide an internal combustion engine having an intake and exhaust port configuration, the opening and closing of which is dependent upon the orientation of the rotating block within the housing.

Yet another object of the present invention is to provide an internal combustion engine which is less expensive to manufacture and operate with respect to fuel efficiency and power production.

In accordance with this objective, it is a further object of the present invention to provide an internal combustion engine requiring fewer working parts—such as the distributor, cam shaft, rocker arms, valves, valve springs, push rods, lifters, gears, pulleys, timing chains, oil pump, water pump—as compared to conventional internal combustion engines.

Yet another object of the present invention is to provide an engine which may be adapted to run in similar fashion to a two-stroke engine, a four-stroke engine, or as a diesel engine.

Further, it is an object of the present invention to provide an internal combustion engine whose operational direction may be selectively reversed.

DISCLOSURE OF THE INVENTION

Other objects and advantages will be accomplished by the present invention which is an internal combustion engine wherein a power train is comprised of two rotating cylinders disposed at a right angle and coupled with a plurality of rods, each defining a 90° bend, wherein the number of pistons is optimized to provide a maximum volume of displacement while defining minimal external dimensions of the engine. Both rotating cylinders define a plurality of cylinder bores radially spaced apart and parallel to the axis of rotation of the respective rotating cylinder. The pair of rotating cylinder, or the receiving cylinder and the power output cylinder, react to an axial force applied to a piston received within one of the cylinder bores defined by the receiving cylinder.

The power output cylinder is received within a lower housing. Conventional methods are employed to rotatably secure the power output cylinder within the lower housing. The receiving cylinder is coupled to the power output cylinder via the plurality of rods. The receiving cylinder is received through an opening defined by the lower housing and is supported by a bearing carried by the lower housing. An upper housing is mounted to the lower housing proximate the opening defined for receiving the receiving cylinder, thus sealing the opening. A head is secured to the upper end of the receiving cylinder such that as the receiving cylinder is rotating, the head rotates likewise. The head is provided for carrying a plurality of spark plugs for igniting compressed fuel and air within each of the cylinder bores at an appropriate time during the operation cycle of the engine. The head is further provided for carrying a plurality of fan blades such that as the receiving cylinder is rotated, a flow of air is created and used for cooling purposes.

The upper housing defines a shroud extending away from the upper end thereof. The shroud extends around at least a portion of the perimeter of the upper housing and carries an ignition lead for contacting the spark plug wires carried by the head. As each spark plug wire contacts the lead wire, and when a current is applied to the lead wire, the respective spark plugs are fired and the compressed fuel and air within the cylinder bore is ignited.

In order to provide for the circulation of oil for lubricating the moving parts within the upper and lower housings, and especially within the upper portion of the upper housing, including the thrust bearing, an oil duct is provided. The oil duct includes a tube member defining a 90° bend, the tube member being secured at each end with bearings mounted within cylindrical bores defined by the rotating cylinders at their respective axes of rotation. Outlet openings are provided proximate the upper end of the oil duct to deliver oil to the thrust bearing. At the upper end of the receiving cylinder, an oil return is provided for removing excess oil. In order to prevent oil from mixing with the fuel in the cylinder, a notch is defined by the rod to force excess oil from within the bushing into the lower housing.

A fuel and air mixture is introduced into the individual cylinder bores through a fuel and air intake port. Fuel is introduced into the air stream through a conventional carburetor pump. After a selected degree of rotation of the receiving cylinder, after the piston in a particular cylinder bore has reached the lower end of its stroke, the fuel and air mixture is introduced into the cylinder bore under the piston through the fuel and air intake port. The fuel and air mixture is then introduced into the volume above the piston via a plurality of transfer ports. After the piston travels upward until the transfer ports are closed, the fuel and air mixture is compressed. Just prior to the upper limit of the stroke of the piston, the spark plug wire associated with the particular cylinder contacts the lead wire which fires the spark plug and ignites the compressed fuel and air.

As the receiving cylinder continues to rotate, the piston begins a downward descent within the cylinder bore. When the air exhaust port opens, the spent fuel is exhausted. When the transfer ports are opened, unspent fuel and air below the piston is forced upward through the transfer ports into the chamber above the piston, which also serves to force out the spent fuel and air.

A water inlet and a water outlet are provided for circulating water through the receiving cylinder for cooling purposes. The water inlet is provided proximate the lower end of the receiving cylinder and the water outlet is provided proximate the upper end. Thus, as the water is introduced into the receiving cylinder, it is heated. As the water is heated, it rises within the receiving cylinder and is then evacuated through the water outlet.

A spring is positioned proximate the bottom of the cylinder bores defined by the receiving cylinder. The spring serves to absorb the inertia of the piston as it approaches the bottom of its stroke. The energy absorbed by the spring is used to help push the piston back toward the top of its stroke.

BRIEF DESCRIPTION OF THE DRAWINGS

The above mentioned features of the invention will become more clearly understood from the following detailed description of the invention read together with the drawings in which.

BEST MODE FOR CARRYING OUT THE INVENTION

A cross-over rod internal combustion engine having a power train oriented at a right angle incorporating various features of the present invention is illustrated generally at 10 in the figures. The cross-over rod internal combustion engine, or engine 10, is designed for providing an internal combustion engine wherein a power train is comprised of two rotating cylinders 12,34 disposed at a right angle and coupled with a plurality of rods 40, each defining a 90° bend, wherein the number of rods 40 is optimized to provide a maximum volume of displacement while defining a minimum size. Moreover, in the preferred embodiment the engine 10 is designed to provide an intake and exhaust port configuration, the opening and closing of which is dependent upon the orientation of the receiving cylinder 12 within the housing. Due to the configuration of the engine 10, the present invention is less expensive to manufacture and operate with respect to fuel efficiency and power production, and requires fewer working parts—such as the distributor, cam shaft, rocker arms, valves, valve springs, push rods, lifters, gears, pulleys, timing chains, oil pump, and the water pump—as compared to conventional internal combustion engines. The engine 10 of the present invention is operable as a two-stroke engine, a four-stroke engine, or as a diesel engine, and its direction of rotation may be reversed.

Figure 1:
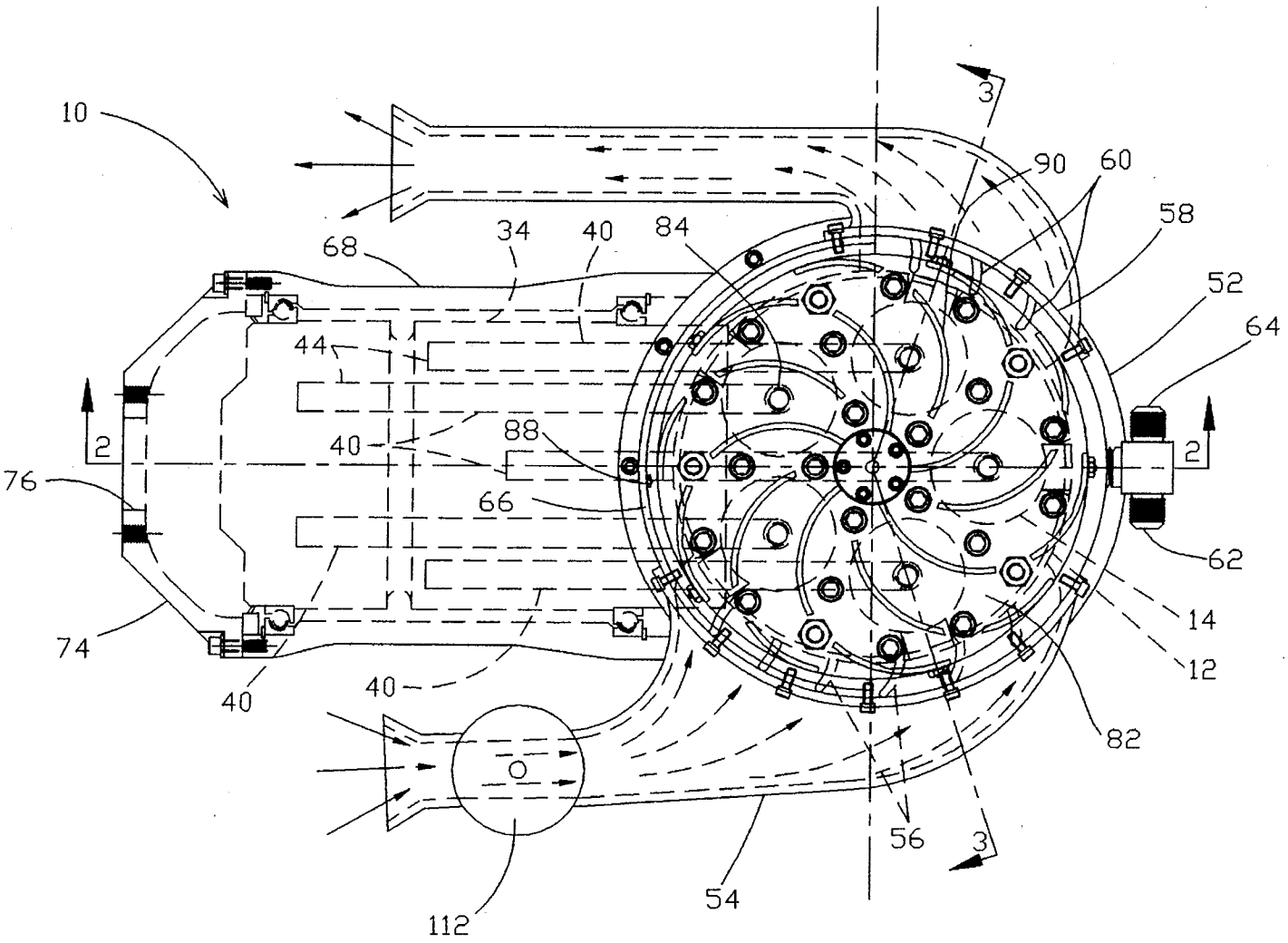
FIG. 1 is a top plan view of the cross-over rod internal combustion engine having a right angle power train constructed in accordance with several features of the present invention.
Figure 2:
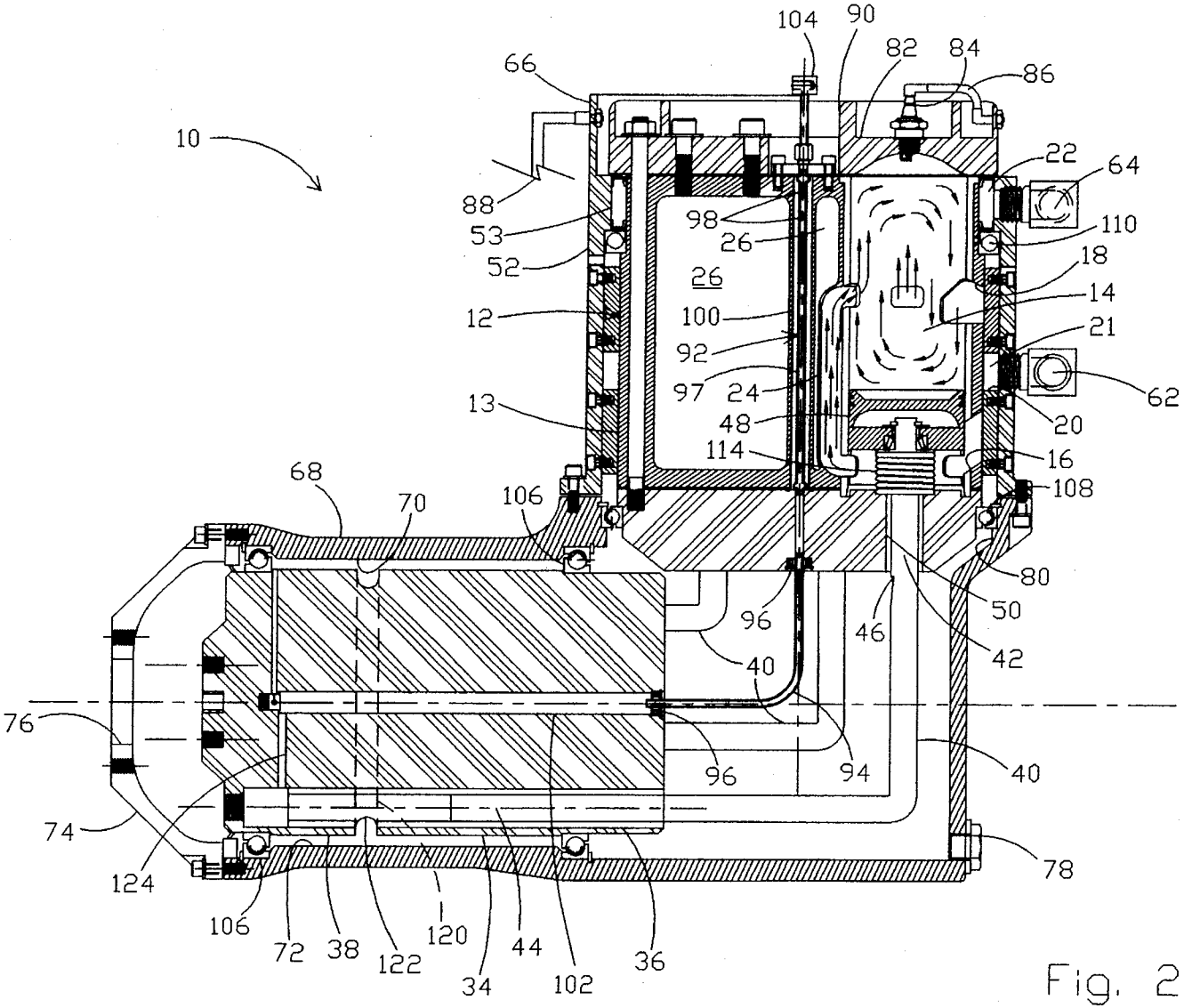
FIG. 2 is a side elevation view, in section, of the cross-over rod internal combustion engine taken at 2—2 of FIG. 1.

A top plan view of the cross-over rod internal combustion engine 10 of the present invention is illustrated in FIG. 1. A side elevational views in section, is shown in FIG. 2. The operation of the engine 10 may be more clearly understood through a discussion referencing FIGS. 1 and 2 simultaneously. The power train of the engine 10 is comprised by a pair of rotating cylinders 12,34 disposed at a right angle to each other and coupled by a plurality of right angle rod members 40. Both rotating cylinders 12,34 define a plurality of cylinder bores 14,36, respectively, radially spaced apart and parallel to the axis of rotation of the respective rotating cylinder 12,34. The pair of rotating cylinders 12,34, hereinafter referred to as the "receiving cylinder 12" and the "power output cylinder 34", react to an axial force applied to a piston 48 received within one of the cylinder bores 14 defined by the receiving cylinder 12.

The power output cylinder 34 is received within a lower housing 68 and is rotatably supported therein by at least one bearing 106.

In the preferred embodiment, a bearing 106 is provided proximate each end of the power output cylinder 34 to prevent unselected movement thereof. Conventional methods are employed to ensure that the bearings 106 and the power output cylinder 34 do not move in a longitudinal direction, such as notching the interior wall 70 of the lower housing 68 and the exterior wall 38 of the power output cylinder 34. In the preferred embodiment, the lower housing 68 defines a cylindrical opening 72 through which the power output cylinder 34 is received. An end plate 74 defining a through opening 76 is then mounted to the lower housing 68 to seal the cylindrical opening the through opening 76 in the end plate 74 being provided for the receipt of an output shaft (not shown). The lower housing 68 is provided with a conventional drain plug 78 to facilitate changing the lubricant within the engine 10.

The receiving cylinder 12 is coupled to the power output cylinder 34 via a plurality of rods 40. As illustrated, the receiving cylinder 12 may be oriented vertically while the power output cylinder 34 is oriented horizontally. The receiving cylinder 12 is received through an opening 80 defined by the lower housing 68 and is supported by a bearing 108 carried by the lower housing 68. An upper housing 52 is mounted to the lower housing 68 proximate the opening 80 defined for receiving the receiving cylinder 12, thus sealing the opening 80. The upper housing 52 is, of course, configured to receive the receiving cylinder 12. A thrust bearing 110 is carried by an upper portion of the upper housing 52 and is provided for supporting the upper end of the receiving cylinder 12. A head member 82 is secured to the upper end of the receiving cylinder 12 such that as the receiving cylinder 12 is rotating, the head member 82 rotates likewise. The head member 82 is provided for carrying a plurality of spark plugs 84 for igniting compressed fuel and air within each of the cylinder bores 14 at an appropriate time during the operation cycle of the engine The head member 82 is further provided for carrying a plurality of fan blades 90 such that as the receiving cylinder 12 is rotated, a flow of air is created and used for cooling purposes.

The upper housing 52 defines a shroud 66 extending away from the upper end thereof. The shroud 66 extends around at least a portion of the perimeter of the upper housing 52 and carries an ignition lead 88 for contacting the spark plug wires 86 carried by the head member 82. As each spark plug wire 86 contacts the lead wire 88, and when a current is applied to the lead wire 88, the respective spark plugs 84 are fired and the compressed fuel and air within the cylinder bore 14 is ignited.

In order to provide for the circulation of oil for lubricating the moving parts within the upper and lower housings 52,68, and especially within the upper portion of the upper housing 52, including the thrust bearing 110, an oil duct 92 is provided. The oil duct 92 includes a tube member 94 defining a 90° bend and a vertical tube 97, the tube member 94 being secured at each end with bearings 96 mounted within cylindrical bores 100,102 defined by the rotating cylinders 12,34 at their respective axes of rotation. The vertical tube 97 is received within the cylindical bore 100 defined by the engine block 12. Outlet openings 98 are provided proximate the upper end of the oil duct 92 to deliver oil to the thrust bearing 10. At the upper end of the receiving cylinder 12, an oil return 104 is provided for removing excess oil. The oil duct 92, including the tube member 94 and the vertical tube member 97, is provided for the passage of oil from the lower housing 68 to the upper portion of the upper housing 52. As illustrated in FIG. 2, a radial groove 120 is defined by the output block 34 with a depth sufficient to create an opening 122 in each of the cylinders 36. Also defined by the output block 34 is a through opening 24 extending between each of the cylinders 36 and the cylindrical bore 102. Thus, as the output block 34 is rotated, oil is captured through each of the openings 122 and a portion thereof is pushed through the through opening 124 to the cylindrical bore 102 as the piston rod second end 44 is moved further into the cylinder 36. Oil forced into the cylindrical bore 102 then travels through the tube member 94 and into the vertical tube 97 received within the engine block 12. Upon reaching the top of the engine block 102, the oil is evacuated from the tube through the openings 98. The bearings 106 and the bearing LOS are each supplied with oil from the lower housing 68, with no ducts being required. In order to prevent oil from mixing with the fuel in the cylinder bore 14, a notch 46 is defined by the rod 40 to force excess oil from within the bushing 50 into the lower housing 68. As the notch 46 of the rod 40 enters into the cylinder bore 14 at the upper limit of the piston stroke, there is substantially no oil in that notch 46. If there is any oil collected in the bottom of the cylinder bore 14, as the rod 40 is retracted, the notch 40 is filled with that oil and pulls it through the bushing 50 and into the lower housing 68. When the notch 40 is withdrawn from the cylinder bore 14, gravitational forces serve to drain the oil therefrom. Thus, no oil is pulled back into the cylinder bore 14 by the notch 46, yet any oil within the cylinder bore 14 is withdrawn.

Figure 3:
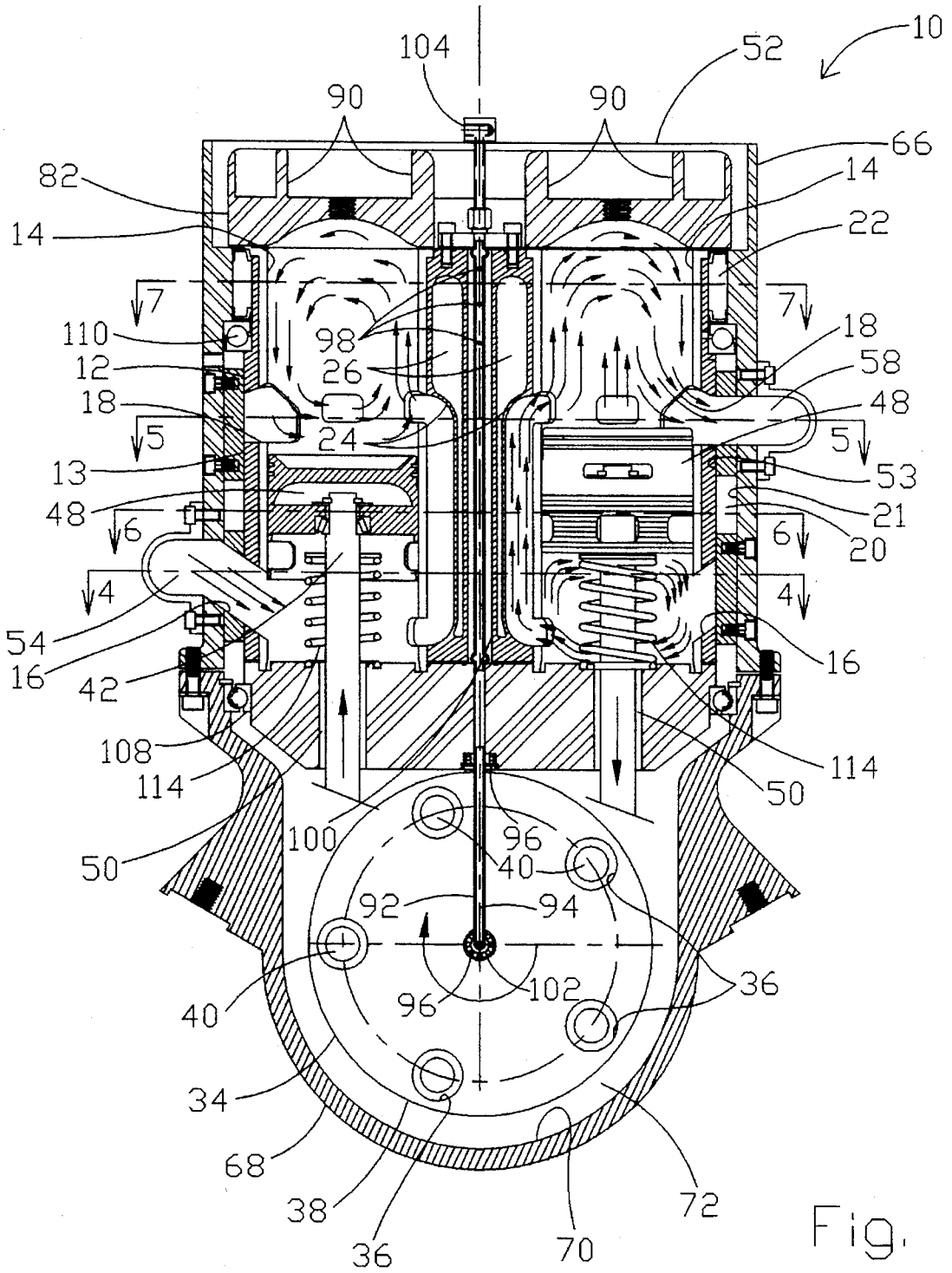
FIG. 3 is an elevation view, in section, of the cross-over rod internal combustion engine taken at 3'3 of FIG. 1.

As is more clearly illustrated in FIG. 3, a fuel and air mixture is introduced into the individual cylinder bores 14 through a fuel and air intake port 16. Fuel is introduced into the air stream through a conventional carburetor as indicated at 12 in FIG. 1. After a selected degree of rotation of the receiving cylinder 12, after the piston 48 in a particular cylinder bore 14 has reached the lower end of its stroke, the fuel and air mixture is introduced into the cylinder bore 14 under the piston 48 through the fuel and air intake port 16. The fuel and air mixture is then introduced into the chamber above the piston 48 via a plurality of transfer ports 24. After the piston 48 travels upward until the transfer ports 24 are closed, the fuel and air mixture is compressed. Just prior to the upper limit of the stroke of the piston 48, the spark plug wire 86 associated with the particular cylinder bore 14 contacts the lead wire 88 which fires the spark plug 84 and ignites the compressed fuel and air.

As the receiving cylinder 12 continues to rotate, the piston 48 begins a downward descent within the cylinder bore 14. When the spent fuel and air exhaust port 18 opens, the spent fuel is exhausted. When the transfer ports 24 are opened, unspent fuel and air below the piston 48 is forced upward through the transfer ports 24 into the chamber above the piston 48, which also serves to force out the spent fuel and air. Due to the configuration of the spent fuel and air exhaust port 58 defined by the upper housing 52 and the spent fuel and air exhaust port 18 defined by the cylinder bores 14, it will be seen that the exhaust of the spent fuel and air is primarily dependent upon the rotational position of the particular cylinder bore 14 with respect to the upper housing 52, and specifically with the spent fuel and air exhaust port 58 defined thereby, as opposed to the axial position of the piston 48 within the cylinder bore 14.

In the preferred embodiment, a spring 114 is positioned proximate the bottom of the cylinder bores 14 defined by the receiving cylinder 12. The spring 114 serves to absorb the inertia of the piston 48 as it approaches the bottom of its stroke. The energy absorbed by the spring 114 is used to help push the piston 48 back toward the top of its stroke.

Thus, the total power output of the engine 10 is not effected by the use of such springs 114.

Figure 4:
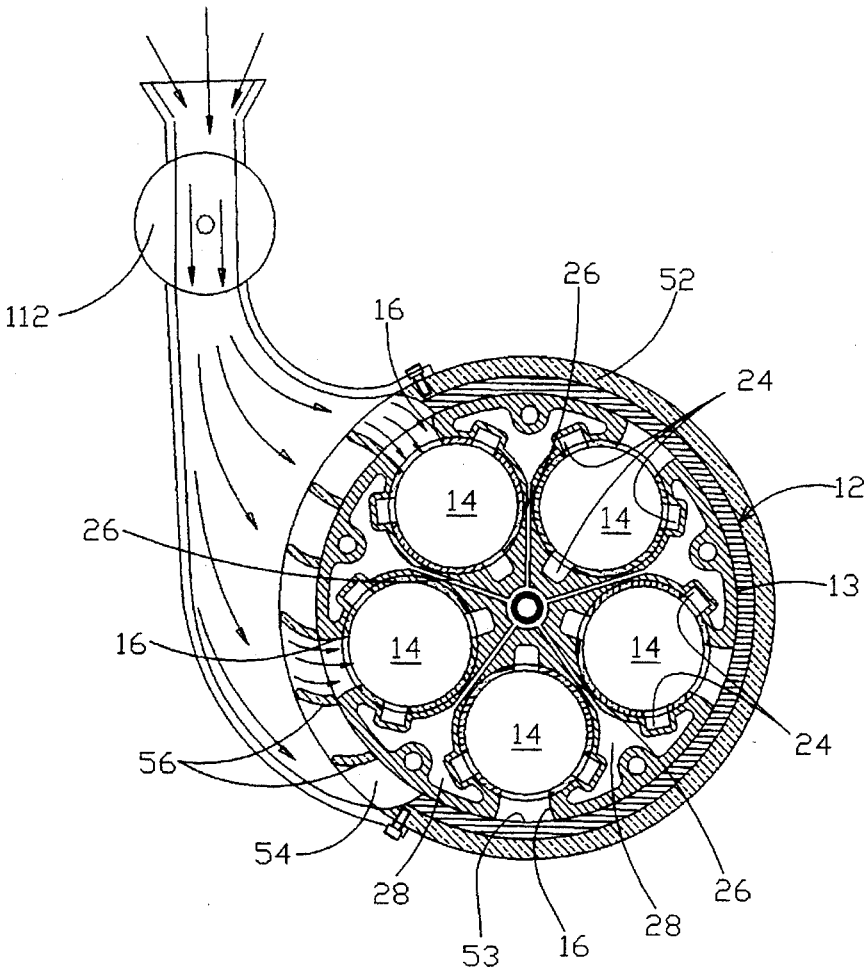
FIG. 4 is a plan view, in section of the cross-over rod internal combustion engine taken at 4—4 of FIG. 3, illustrating the fuel and air intake port.

FIG. 4 illustrates in greater detail a cross-section of the receiving cylinder 12 and upper housing 52 at the elevation of the fuel and air intake port 54. A portion of the perimeter of the upper housing 52 defines the fuel and air intake port 54. Each of the cylinder bores 14 defines a fuel and air intake port 16 such that when the fuel and air intake port 16 of a cylinder bore 14 and the fuel and air intake port 54 defined by the upper housing 52 are aligned, a fuel and air mixture is introduced into the cylinder bore 14. A plurality of fins 56 is carried by the upper housing 52 to direct the fuel and air mixture into the cylinder bores 14. As the receiving cylinder 12 rotates, the fins 56 serve to direct the fuel and air mixture into the open cylinder bores 14. Further illustrated are three transfer ports 24 for transferring fuel and air from below the piston 48 into the chamber above the piston 48. Illustrated between the cylinder walls of the individual cylinder bores 14 is the volume 26 for carrying water.

Figure 5:
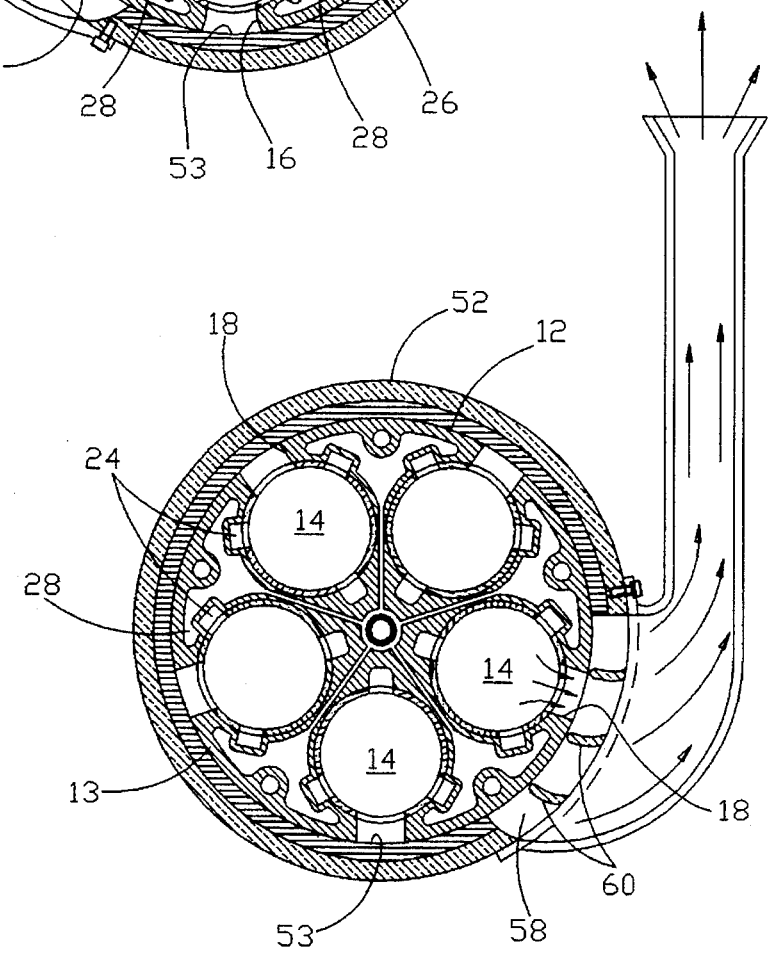
FIG. 5 is a plan view, in section of the cross-over rod internal combustion engine taken at 5—5 of FIG. 3, illustrating the spent fuel and air exhaust port.

Similarly illustrated in FIG. 5 is a cross-section of the receiving cylinder 12 and upper housing 52 at the elevation of the spent fuel and air exhaust port 58. As the spent fuel and air exhaust port 18 defined by a cylinder bore 14 is aligned with the spent fuel and air exhaust port 58 defined by the upper housing 52, spent fuel and air is evacuated from the cylinder bore 14.

A plurality of fins 60 is carried by the upperhousing 52 to enhance the exhausting of spent fuel and air.

With respect to both the fuel and air intake and exhaust ports 54,58, the timing of the intake and exhaust of fuel and air may be controlled by varying the length of the respective ports 54,58 and the positioning of the ports 54,58 along the circumference of the upper housing 52. As discussed previously, due to the configuration of the fuel and air intake and exhaust ports 54,58 defined by the upper housing 52 and the fuel and air intake and exhaust ports 16,18 defined by the cylinder bore 14, the intake of fresh fuel and air and the exhaust of spent fuel and air is dependent primarily upon the rotational orientation of the particular cylinder bore 14 with respect to the upper housing 52 as opposed to the axial position of the piston 48 within the cylinder bore 14.

Referring back to FIG. 3, a water inlet 20 and a water outlet 22 are provided for circulating water through the receiving cylinder 12 for cooling purposes. The water inlet 20 is provided proximate the lower end of the receiving cylinder 22 and the water outlet 22 is provided proximate the upper end. Thus, as the water is introduced into the engine 10, it is heated. As the water is heated, it rises within the engine 10 and is then evacuated through the water outlet 22. A more detailed description of the water inlet 20 and outlet is discussed below in relation to FIGS. 6 and 7, respectively.

Figure 6:
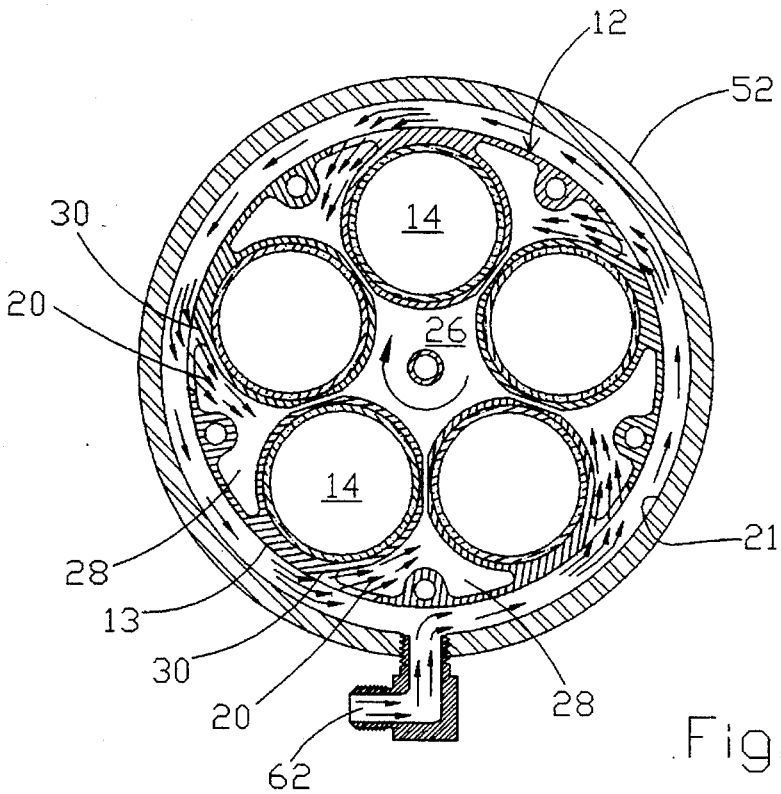
FIG. 6 is a plan view, in section of the cross-over rod internal combustion engine taken at 6—6 of FIG. 3, illustrating the water inlet.
Figure 7:
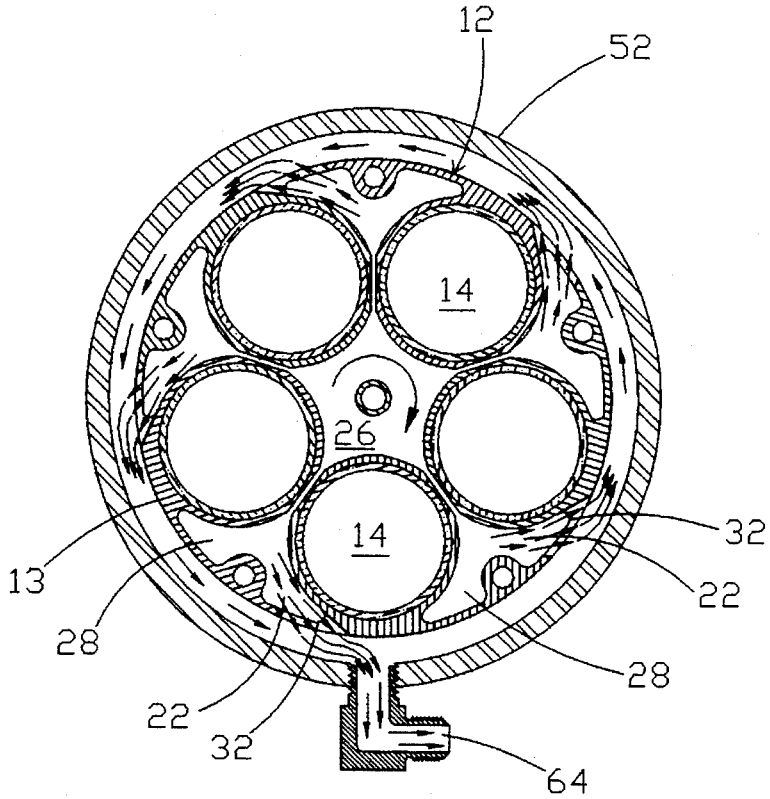
FIG. 7 is a plan view, in section of the cross-over rod internal combustion engine taken at 7—7 of FIG. 3, illustrating the water outlet.

FIG. 6 is a cross-sectional view of the receiving cylinder 12 and the upper housing at the level of the water inlet 62. A channel 21 is defined by the interior wall 53 of the upper housing 52 for circulating water around the outer wall 13 of the receiving cylinder Water inlet ports 20 are defined by the receiving cylinder 12 between each of the individual cylinder bores 14. As shown, a triangular volume 28 is defined between each of the cylinder bores 14 and the outer wall 13 of the receiving cylinder 12. The water inlet ports 29 are defined proximate the leading edge 30 of the triangular volume 28 such that water is scooped into the triangular volume FIG. 7 illustrates a cross-sectional view of the receiving cylinder 12 and the upper housing 52 at the elevation of the water outlet port 64. The receiving cylinder 12 defines a water outlet port 22 between each of the cylinder bores 14 proximate the trailing edge 32 of the triangular volume 28 such that water is evacuated therefrom due to centrifugal forces.

In the preferred embodiment of the engine 10, five rods 40 are provided. A minimum number of cylinder bores 14 is preferred in order to minimize the diameter of the receiving cylinder 12. Minimizing the size of the receiving cylinder 12 also reduces the required rotating force. However, fewer than five cylinder bores 14 reduces the efficiency of the engine be. For maximum efficiency, the angle between the respective cylinder bores 14 must be less than 90°, therefore, five cylinder bores 14 are preferred.

As disclosed and illustrated, the rods 40 each define a 90° bend. Thus, the force exerted on the rod 40 via the piston 48 is directed substantially in an axial direction. A substantial portion of that force is thus used as a rotational force on the power output cylinder 34.

Although a cycle has been disclosed wherein the spark plug 84 for a given cylinder bore b4 fires each time it contacts the lead wire 88, it will be understood that the lead wire 88 may be actuated for every other cylinder bore 14 such that each cylinder bore 14 fires on every other stroke. Thus, the engine 10 may be operated as a four-cycle engine. It will be further understood that the engine be may be adapted to operate in similar fashion to a conventional diesel engine.

Because of the construction of the engine 10 of the present invention, the engine 10 is less-expensive to manufacture than conventional internal combustion engines. Further, fewer parts are required to operate the engine 10 as compared to conventional internal combustion engines. Though not limited to these, included in the parts not required by the present invention are the distributor, cam shaft, rocker arms, valves, valve springs, push rods, lifters, gears, pulleys, timing chains, and oil pump. Because of the lack of these working parts, more efficient operation of the engine 10 is provided by reducing the power required to operate the peripheral components, which in turn provides for greater fuel economy and power production.

As described, the crank case area, within the lower housing 68, is separate from the cylinder bore 14 and fluid communication is prevented by the rod bushing 50. Hence, oil contaminants are prevented from mixing with the fuel and air mixture and fuel contaminants are prevented from mixing in the oil.

From the foregoing description, it will be recognized by those skilled in the art that an cross-over rod internal combustion engine offering advantages over the prior art has been provided. Specifically, the engine provides an internal combustion engine wherein a power train is comprised of two rotating cylinders disposed at a right angle and coupled with a plurality of rods, each defining a 90° bend. The engine of the preferred embodiment incorporates five rods to provide a maximum power output while defining a minimum size. The engine of the present invention provides an intake and exhaust port configuration wherein the opening and closing of which is dependent upon the orientation of the rotating cylinder within the housing. Due to the configuration of the engine, the present invention is less expensive to manufacture and operate with respect to fuel efficiency and power production, and requires fewer working parts—such as the distributor, cam shaft, rocker arms,. valves, valve springs, push rods, lifters, gears, pulleys, timing chains, oil pump, and water pump—as compared to conventional internal combustion engines. The engine of the present invention is operable as a two-stroke engine, a four-stroke engine, or as a diesel engine, and its direction of rotation may be reversed.

While a preferred embodiment has been shown and described, it will be understood that it is not intended to limit the disclosure, but rather it is intended to cover all modifications and alternate methods falling within the spirit and the scope of the invention as defined in the appended claims.

Having thus described the aforementioned invention, I claim:

1. A cross-over rod internal combustion engine comprising:

a receiving cylinder defining a plurality of cylinder bores spaced radially apart one from another, said receiving cylinder being rotatably mounted within a housing, said plurality of cylinder bores being disposed parallel to an axis of rotation of said receiving cylinder;

a head member secured to an upper end of said receiving cylinder to close an upper end of each of said plurality of cylinder bores;

a power output cylinder defining a plurality of cylinder bores spaced radially apart one from another, said power output cylinder being rotatably mounted within said housing, said plurality of cylinder bores being disposed parallel to an axis of rotation of said power output cylinder;

a plurality of rods, each of said plurality of rods defining a right angle bend, each of said plurality of rods defining a first end being received within one of said plurality of cylinder bores defined by said receiving cylinder and a second end being received within one of said plurality of cylinder bores defined by said power output cylinder;

a plurality of pistons, one each of said plurality of pistons being carried by said first end of one each of said plurality of rods and received within one each of said plurality of cylinder bores defined by said receiving cylinder;

a fuel and air intake port defined by said housing for introducing a fuel and air mixture into said plurality of cylinder bores defined by said receiving cylinder, said fuel and air intake port cooperating with an intake port defined by each of said plurality of cylinder bores defined by said receiving cylinder during a selected portion of a rotation of said receiving cylinder;

a spent fuel and air exhaust port defined by said housing for evacuating spent fuel and air from said plurality of cylinder bores defined by said receiving cylinder, said spent fuel and air exhaust port cooperating with an exhaust port defined by each of said plurality of cylinder bores defined by said receiving cylinder during a selected portion of said rotation of said receiving cylinder, opening of said spent fuel and air exhaust port with respect to one of said plurality of cylinder bores defined by said receiving cylinder being dependent upon an orientation of said receiving cylinder within said housing an a being at least partially independent of a displacement of one of said plurality of pistons received within said one of said plurality of cylinder bores;

a water inlet port defined by said housing for introducing water into an interior volume defined by said receiving cylinder; and a water outlet port defined by said housing for evacuating water from said interior volume defined by said receiving cylinder.

2. The cross-over rod internal combustion engine of claim 1 wherein said fuel and air intake port is disposed proximate a lower end of said plurality of cylinder bores defined by said receiving cylinder such that the fuel and air mixture is introduced into said plurality of cylinder bores below said plurality of pistons, and wherein said spent fuel and air exhaust port is disposed proximate an upper end of said plurality of cylinder bores defined by said receiving cylinder such that the spent fuel and air mixture is evacuated from said plurality of cylinder bores above said plurality of pistons, said cross-over rod internal combustion engine further comprising at least one transfer port associated with each of said plurality of cylinder bores for transferring the fuel and air mixture from below said plurality of pistons to above said plurality of pistons.

3. The cross-over rod internal combustion engine of claim 1 further comprising a lead wire carried by said housing at an upper end thereof and a plurality of ignition devices for igniting the fuel and air mixture above said plurality of pistons, said plurality of ignition devices being carried by said head member, one each of said plurality of ignition devices being disposed proximate one each of said cylinder bores defined by said receiving cylinder above said piston received therein, each of said plurality of ignition devices being fired upon contact with said lead wire, said contact being made as said receiving cylinder is rotated, thus said plurality of ignition devices being brought into said contact in sequential fashion, said ignition of the fuel and air mixture in one of said plurality of cylinder bores above said piston received therein creating an axial force on said first end of one of said plurality of rods, said axial force being transferred as a rotational force on said power output cylinder through said second end of said one of said plurality of rods.

4. The cross-over rod internal combustion engine of claim 1 further comprising a fan carried by said head member to create an air flow upon rotation of said receiving cylinder.

5. The cross-over rod internal combustion engine of claim 1 further comprising a plurality of blade members carried by said housing within said fuel and air intake port for directing introduction of fuel and air into each of said plurality of cylinder bores.

6. The cross-over rod internal combustion engine of claim 1 further comprising a plurality of blade members carried by said housing within said spent fuel and air exhaust port for directing evacuation of spent fuel and air from within each of said plurality of cylinder bores.

7. The cross-over rod internal combustion engine of claim 1 wherein each of said plurality of rods defines a notched portion proximate a point of entry into said plurality of cylinder bores defined by said receiving cylinder, said notched portion being provided for withdrawing excess oil from between said plurality of cylinder bores and respective of said plurality of rods in order to prevent mixture of oil with fuel within said plurality of cylinder bores defined by said receiving cylinder and within said housing external of said receiving cylinder.

8. The cross-over rod internal combustion engine of claim 1 further comprising a lubricant duct for circulating lubricant to at least an upper end of said receiving cylinder.

9. A cross-over rod internal combustion engine comprising:

a receiving cylinder defining a plurality of cylinder bores spaced radially apart one from another, said receiving cylinder being rotatably mounted within a housing, said plurality of cylinder bores being disposed parallel to an axis of rotation of said receiving cylinder;

a head member secured to an upper end of said receiving cylinder to close an upper end of each of said plurality of cylinder bores;

a power output cylinder defining a plurality of cylinder bores spaced radially apart one from another, said power output cylinder being rotatably mounted within said housing, said plurality of cylinder bores being disposed parallel to an axis of rotation of said power output cylinder;

a plurality of rods, each of said plurality of rods defining a right angle bend, each of said plurality of rods defining a first end being received within one of said plurality of cylinder bores defined by said receiving cylinder and a second end being received within one of said plurality of cylinder bores defined by said power output cylinder;

a plurality of pistons, one each of said plurality of pistons being pivotally carried by said first end of one each of said plurality of rods and received within one each of said plurality of cylinder bores defined by said receiving cylinder, each of said plurality of pistons being able to freely rotate about a longitudinal axis of said first end of said one each of said plurality of rods in order to allow each of said plurality of pistons to remain in a constant orientation with respect to each of said plurality of cylinder bores defined by said receiving cylinder;

a fuel and air intake port defined by said housing for introducing a fuel and air mixture into said plurality of cylinder bores defined by said receiving cylinder, said fuel and air intake port cooperating with an intake port defined by each of said plurality of cylinder bores defined by said receiving cylinder during a selected portion of a rotation of said receiving cylinder, said fuel and air intake port being disposed proximate a lower end of said plurality of cylinder bores defined by said receiving cylinder such that the fuel and air mixture is introduced into said plurality of cylinder bores below said plurality of pistons;

a spent fuel and air exhaust port defined by said housing for evacuating spent fuel and air from said plurality of cylinder bores defined by said receiving cylinder, said spent fuel and air exhaust port cooperating with an exhaust port defined by each of said plurality of cylinder bores defined by said receiving cylinder during a selected portion of said rotation of said receiving cylinder, said spent fuel and air exhaust port being disposed proximate an upper end of said plurality of cylinder bores defined by said receiving cylinder such that the spent fuel and air mixture is evacuated from said plurality of cylinder bores above said plurality of pistons, opening of said spent fuel and air exhaust port with respect to one of said plurality of cylinder bores defined by said receiving cylinder being dependent upon an orientation of said receiving cylinder within said housing and being at least partially independent of a displacement of one of said plurality of pistons received within said one of said plurality of cylinder bores;

at least one transfer port associated with each of said plurality of cylinder bores for transferring the fuel and air mixture from below said plurality of pistons to above said plurality of pistons;

a water inlet port defined by said housing for introducing water into an interior volume defined by said receiving cylinder;

a water outlet port defined by said housing for evacuating water from said interior volume defined by said receiving cylinder; and a lead wire carried by said housing at an upper end thereof and a plurality of ignition devices for igniting the fuel and air mixture above said plurality of pistons, said plurality of ignition devices being carried by said head member, one each of said plurality of ignition devices being disposed proximate one each of said plurality of cylinder bores defined by said receiving cylinder above said piston received therein, each of said plurality of ignition devices being fired upon contact with said lead wire, said contact being made as said receiving cylinder is rotated, thus said plurality of ignition devices being brought into said contact in sequential fashion, said ignition of the fuel and air mixture in one of said plurality of cylinder bores above said piston received therein creating an axial force on said first end of one of said plurality of rods, said axial force being transferred as a rotational force on said power output cylinder through said second end of said one of said plurality of rods.

10. The cross-over rod internal combustion engine of claim 9 further comprising a fan carried by said head member to create an air flow upon rotation of said receiving cylinder.

11. The cross-over rod internal combustion engine of claim 9 further comprising a plurality of blade members carried by said housings within said fuel and air intake port for directing introduction of fuel and air into each of said plurality of cylinder bores.

12. The cross-over rod internal combustion engine of claim 9 further comprising a plurality of blade members carried by said housing within said spent fuel and air exhaust port for directing evacuation of spent fuel and air from within each of said plurality of cylinder bores.

13. The cross-over rod internal combustion engine of claim 9 wherein each of said plurality of rods defines a notched portion proximate a point of entry into said plurality of cylinder bores defined by said receiving cylinder, said notched portion being provided for withdrawing excess oil from between said plurality of cylinder bores and respective of said plurality of rods in order to prevent mixture of oil with fuel within said plurality of cylinder bores defined by said receiving cylinder and within said housing external of said receiving cylinder.

14. The cross-over rod internal combustion engine of claim 9 further comprising a lubricant duct for circulating lubricant to at least an upper end of said receiving cylinder.

15. The cross-over rod internal combustion engine of claim 1 wherein each of said plurality of cylinder bores defined by said receiving cylinder and by said power output cylinder consists of five cylinder bores, wherein said plurality of rods consists of five rods, and wherein said plurality of pistons consists of five pistons.

16. The cross-over rod internal combustion engine of claim 9 wherein each of said plurality of cylinder bores defined by said receiving cylinder and by said power output cylinder consists of five cylinder bores, wherein said plurality of rods consists of five rods, wherein said plurality of pistons consists of five pistons, and wherein said plurality of ignition devices consists of five ignition devices.

17. A cross-over rod internal combustion engine comprising:

a receiving cylinder defining five cylinder bores spaced radially apart one from another, said receiving cylinder being rotatably mounted within a housing, said five cylinder bores being disposed parallel to an axis of rotation of said receiving cylinder;

a head member secured to an upper end of said receiving cylinder to close an upper end of each of said five receiving cylinder bores;

a fan carried by said head member to create an air flow upon rotation of said receiving cylinder;

a power output cylinder defining five cylinder bores spaced radially apart one from another, said power output cylinder being rotatably mounted within said housing, said five cylinder bores being disposed parallel to an axis of rotation of said power output cylinder;

five rods each defining a right angle bend, each of said five rods defining a first end being received within one of said five cylinder bores defined by said receiving cylinder and a second end being received within one of said five cylinder bores defined by said power output cylinder, each of said five rods defining a notched portion proximate a point of entry into said five cylinder bores defined by said receiving cylinder, said notched portion being provided for withdrawing excess oil from between said five cylinder bores and respective of said five rods in order to prevent mixture of oil with fuel within said five cylinder bores defined by said receiving cylinder and within said housing external of said receiving cylinder;

five pistons, one each being pivotally carried by said first end of one each of said five rods and received within one each of said five cylinder bores defined by said receiving cylinder, each of said five pistons being able to freely rotate about a longitudinal axis of said first end of said one each of said five rods in order to allow each of said five pistons to remain in a constant orientation with respect to each of said five cylinder bores defined by said receiving cylinder;

a fuel and air intake port defined by said housing for introducing a fuel and air mixture into said five cylinder bores defined by said receiving cylinder, said fuel and air intake port cooperating with an intake port defined by each of said five cylinder bores defined by said receiving cylinder during a selected portion of a rotation of said receiving cylinder, said fuel and air intake port being disposed proximate a lower end of said five cylinder bores defined by said receiving cylinder such that the fuel and air mixture is introduced into said five cylinder bores below said five pistons, said housing defining a plurality of blade members within said fuel and air intake port for directing introduction of fuel and air into each of said five cylinder bores;

a spent fuel and air exhaust port defined by said housing for evacuating spent fuel and air from said five cylinder bores defined by said receiving cylinder, said spent fuel and air exhaust port cooperating with an exhaust port defined by each of said five cylinder bores defined by said receiving cylinder during a selected portion of said rotation of said receiving cylinder, said spent fuel and air exhaust port being disposed proximate an upper end of said five cylinder bores defined by said receiving cylinder such that the spent fuel and air mixture is evacuated from said five cylinder bores above said five pistons, opening of said spent fuel and air exhaust port with respect to one of said five cylinder bores defined by said receiving cylinder being dependent upon an orientation of said receiving cylinder within said housing and being at least partially independent of a displacement of one of said five pistons received within said one of said five cylinder bores, said housing defining a plurality of blade members within said spent fuel and air exhaust port for directing evacuation of spent fuel and air from within each of said five cylinder bores;

at least one transfer port associated with each of said five cylinder bores for transferring the fuel and air mixture from below said five pistons to above said five pistons;

a lubricant duct for circulating lubricant to at least an upper end of said receiving cylinder;

a water inlet port defined by said housing for introducing water into an interior volume defined by said receiving cylinder;

a water outlet port defined by said housing for evacuating water from said interior volume defined by said receiving cylinder; and a lead wire carried by said housing at an upper end thereof and five ignition devices for igniting the fuel and air mixture above said five pistons, said five ignition devices being carried by said head member, one each of said five ignition devices being disposed proximate one each of said five cylinder bores defined by said receiving cylinder above said piston received therein, each of said five ignition devices being fired upon contact with said lead wire, said contact being made as said receiving cylinder is rotated, thus said five ignition devices being brought into said contact in sequential fashion, said ignition of the fuel and air mixture in one of said five cylinder bores above said piston received therein creating an axial force on said first end of one of said five rods, said axial force being transferred as a rotational force on said power output cylinder through said second end of said one of said five rods.

* * * * *